United States Patent [19]

Rothenberger

[11] 4,154,083

[45] May 15, 1979

[54] EXPANDING HEAD FOR PIPE END ENLARGING TOOLS

[75] Inventor: Günter Rothenberger, Bad Homburg, Fed. Rep. of Germany

[73] Assignee: Rothenberger GmbH & Co. Werkzeuge-Maschinen KG, Frankfurt am Main, Fed. Rep. of Germany

[21] Appl. No.: 854,431

[22] Filed: Nov. 23, 1977

[30] Foreign Application Priority Data

Nov. 29, 1976 [DE] Fed. Rep. of Germany ..... 2654102

[51] Int. Cl.[2] ..... B21D 41/02

[52] U.S. Cl. ..... 72/393

[58] Field of Search ..... 72/393

[56] References Cited

U.S. PATENT DOCUMENTS

| | | | |
|---|---|---|---|
| 366,644 | 9/1907 | Green | 72/393 |
| 888,239 | 5/1908 | Kelly | 72/393 |
| 907,396 | 12/1908 | Passat | 72/393 |
| 3,385,087 | 5/1968 | Huth | 72/393 |
| 4,034,591 | 7/1977 | Rothenberger | 72/393 |

*Primary Examiner*—Lowell A. Larson

*Attorney, Agent, or Firm*—Sprung, Felfe, Horn, Lynch & Kramer

[57] ABSTRACT

An expanding head for pipe end enlarging tools which have a tool body including a cylindrical end portion and a removable mandrel having a tapered end extending through the cylindrical end portion of the body and axially movable therein. The expanding head comprises a plurality of exchangeable segmental expanding elements each having a flange segment which together form a radially outwardly extending annular flange. The segments are connected together to unite them as a self-contained set and for radial movement in response to axial movement of the mandrel when in use. The segments are connected by a spring element which surrounds the segments at the annular flange and clamps them against each other and against the mandrel. The segments are removably connected to the cylndrical portion of the tool body without detachment of the spring element to maintain the segments in the self-contained set. This removable connection is carried out by a sleeve connectable to the cylindrical portion of the tool body coaxially with the mandrel and having an inwardly extending annular flange positionable behind the annular flange of the segments to coact therewith to mount the segments in position around the mandrel.

11 Claims, 6 Drawing Figures

FIG. 1
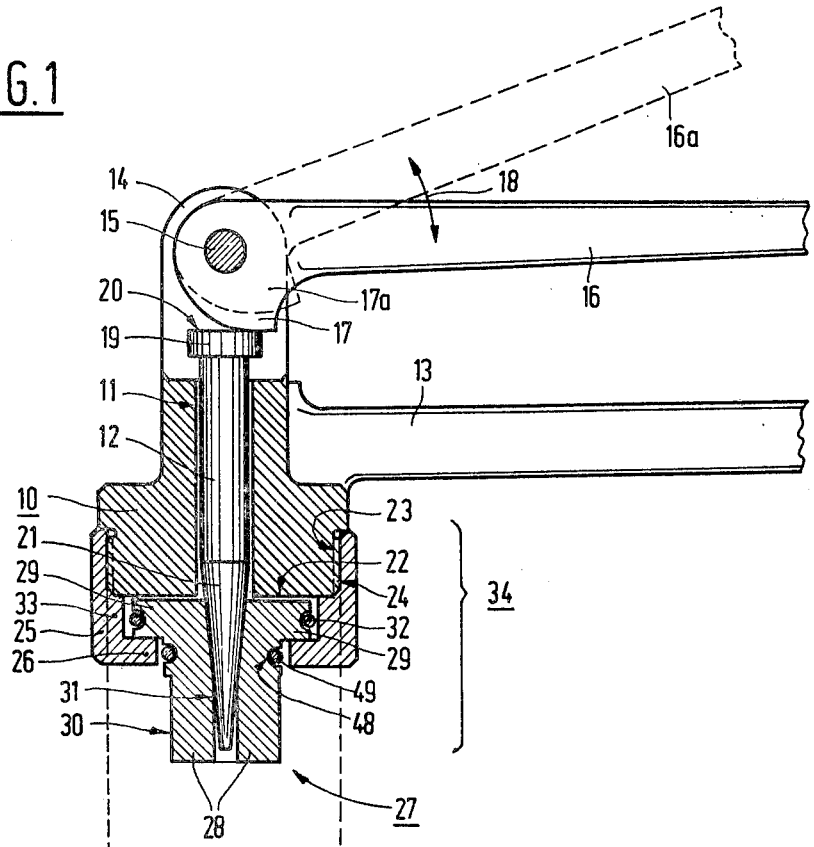
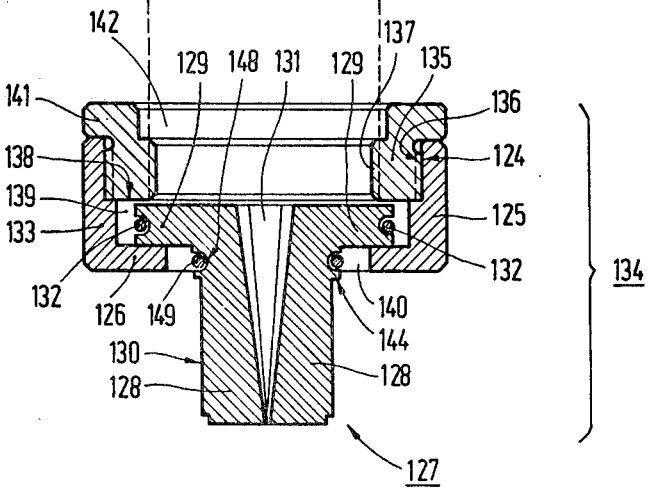
FIG. 2

142
137
135
141

136
147
138

143
131
151
131
129
127
129
148
144
128

132
150
130
130
128
128
145
124
133
146
126

125

EXPANDING HEAD FOR PIPE END ENLARGING TOOLS

BACKGROUND OF THE INVENTION

The invention relates to an expanding head for tools for enlarging the ends of pipes and having a tool body, a mandrel which is mounted in and can be moved from the tool body and the end of which is tapered, the expanding head comprising a sleeve, which is connectible to the tool body coaxially with the mandrel and has an inwardly extending flange, and a plurality of exchangeable segmental expanding elements, which can be radially displaced in the sleeve by means of the mandrel and which are provided with flange segments, which together form an annular flange and which engage behind the sleeve flange and are all surrounded by a spring element which clamps them against each other and against the mandrel.

Tools for enlarging the ends of pipes and having exchangeable expanding heads are quite well known. In these tools, the tool body or basic tool generally includes a plurality of expanding heads, the expanding elements of which having different diameters such that their outer faces define cylindrical working surfaces. This arrangement is used to enable pipes of different diameters to be enlarged with one and the same basic tool. The companion dimensions of the connection, usually a screw-threaded connection between the expanding head and the tool body, are generally the same within a particular diameter range.

Threaded spindles, eccentrics, cams or hydraulic or pneumatic piston-and-cylinder units are used for driving the mandrel. In each case, the driving forces which are necessary for expanding the pipe and which depend upon the material and wall-thickness of the pipe and upon the transmission and friction conditions within the pipe-expanding tool, are considerable in some circumstances. The increase in the diameter of the pipe caused by the expanding operation must be at least so great that a pipe having the original diameter can be inserted into the widened portion, and in addition a sufficiently large gap must be present for accommodating soldering material introduced by capillary action. This means that the minimum increase in diameter must be greater than twice the wall-thickness of the pipe concerned.

The above-mentioned requirements render it necessary to have a relatively strong spring element for automatically retracting the expanding elements, which spring element must also have a flat characteristic curve so that no overstraining accompanied by permanent set can occur. If possible, the spring element should also be capable of returning the mandrel to its initial position so that the expanding elements can be retracted. An arrangement that has proved successful is that of fitting the spring element in an annular groove around the flange segments, since these, supported by further guide means, are responsible for the radial guiding of the expanding elements, so that the arrangement of the spring element on the flange segments makes it impossible for the expanding elements to tilt under the action of the spring since no tilting moments can occur.

U.S. Pat. No. 2,999,529 discloses an expanding head in which the expanding elements and the sleeve are interconnected by rivets which cannot, of course, be removed without being destroyed. The rivets extend, on the one hand, through the sleeve flange and, on the other hand, through the flange segments of the expanding elements, radial movement being made possible by the presence of slots in the sleeve flange. Should one of the expanding elements become unusable due to, for example, breakage, this results in troublesome repair work. In particular however, each of the expanding heads belonging to a set consists of expanding elements and a sleeve. The operator therefore has a very heavy weight to handle, since it follows that expanding heads for pipe diameters of between approximately 10 and 60 mm generally have to be carried about. Moreover, the complete expansion heads are relatively costly.

Also, German Patent Specification AS 24 59 506 discloses the idea of dispensing with rivets as the guide and fixing means and of replacing them by providing a second flange segment on the expanding elements, which second segment is disposed outside the sleeve. Thus, an annular groove, in which the sleeve flange engages, is formed between the flange segments. However, because of the overlapping necessary for ensuring reliable functioning, the expanding elements can only be removed individually one after the other from the sleeve and refitted therein. For this purpose, the spring element, in the form of a helical spring, must be removed before the expanding elements are taken out. Difficult as the removal of the spring element is, its reintroduction is even more so. To enable the spring to be fitted on the flange segments within the sleeve, it must be relatively easy to bend, i.e. "soft". Such softness does not however guarantee that the expanding elements will be held together in a reliable manner after they have been removed from the sleeve. The danger of expanding elements of different sets becoming mixed up therefore arises. Although the known system enables repairs to be carried out in a simple manner by replacing individual expanding elements, it does not meet the requirement of enabling complete sets of expanding elements to be exchanged on a routine basis and without problems when, for example, the work has to be carried out on a building site. Furthermore, the second flange segment entails a corresponding increase in the length of the expanding elements, so that there is increased bending load accompanied by the danger of fracture at the weakest place, i.e., in the floor of the annular groove. In particular, however, relatively narrow top limits are imposed upon the outside diameter of the working surfaces of the expanding element for given sleeve dimensions. Because of the difficulties associated with the operation of exchanging the sets of expanding elements, the user will bring along complete expanding heads plus sleeve.

SUMMARY OF THE INVENTION

The object of the present invention is therefore to provide an expanding head of the initially described kind in which a single sleeve of predetermined dimensions can be fitted in an extremely simple manner with different sets of expanding elements.

According to the invention and in the case of the initially described expanding head, this object is achieved in that the expanding elements are designed to be removable, as a self-contained set, from the sleeve without detachment of the spring element and are united by means of the spring element so that they cannot get lost.

This design requirement is met by dispensing with the rivets and the outer flange segments, so that when the sleeve is removed, the expanding elements can be withdrawn, as a self-contained set, rearwardly through the sleeve flange, the set being held together by the spring element. Since the spring element, which does not need to be removed, can be made correspondingly rigid, individual expanding elements cannot get lost. It is of course nevertheless possible to exchange individual expanding elements for repair purposes, but to do this, greater forces are required than those that can occur by change for example in a tool-box.

For creating the situation in which the expanding elements cannot get lost, it has been found advantageous to surround the flange segments with a solid spring bent to a circular shape. In the simplest case, use can be made of a spring-steel wire bent to circular shape and having a line of separation as in the case of a piston ring. The fitting of such a ring around the periphery of the flange segments meets the requirement regarding the provision of a sufficiently large spring travel, so that the spring is not overstrained during the normal expansion movements. At the same time it is strong enough to retract the expanding elements while simultaneously withdrawing the mandrel when the driving force is not applied to the mandrel.

The article of the invention may however also be designed so that the expanding elements are provided with a groove-like machined recess at the place where they extend through the sleeve flange, in which recess is fitted a further spring element which can be likewise removed from the sleeve together with the set of expanding elements. By providing two spring elements near the inner end of the expanding elements, i.e. at the place where the expanding elements are in sliding contact with the mandrel during its entire stroke, the individual expanding elements can be endowed with considerable stability against tilting or uneven spreading. By providing two spring elements at the stated location, it is even possible for at least one of the two spring elements to have soft characteristics, i.e. to provide for example what is called an O-ring, without running the risk of the expanding elements coming apart after they have been removed from the sleeve. If however it is required to provide large return forces, which are particularly advantageous in the case of sets of expanding elements of large diameter, it is preferred to use steel springs, and in particular solid springs, as the two spring elements, the line of separation in one of the spring elements being offset through 180° from that of the other so as to promote uniformity in the expanding action.

At all times, the equipment in accordance with the invention offers the advantage that the user of the pipe-expanding tool, when dealing with a whole range of pipe diameters, has only to carry with him a single sleeve together with the necessary sets of expanding elements which he can always insert in, and remove from the sleeve as required, without complicated manipulations. Then, the only further requirement is to screw the sleeve with the set of expanding elements onto the body of the tool, and the tool is ready for use. A considerable saving in weight and cost is associated with this system. These advantages have been achieved without any offsetting disadvantages since, surprisingly, it has been found that, because of the centering action of the mandrel, on the one hand, and of the pipe during its deformation, on the other hand, the expanding jaws are sufficiently accurately guided to enable the expanding head to operate in a reliable manner without the use of additional means such as rivets in slots, or two sets of flange segments. Furthermore, because of the absence of outer flange segments, it has proved possible to use expanding elements of shorter axial dimensions. Thus, the lever-arm and the angle of tilt of the individual expanding elements are considerably reduced particularly at the commencement of the expanding movement. Here, it must be borne in mind that the maximum load occurs at the outer ends of the expanding elements, while, at this moment, the tip of the mandrel is still mainly at the inlet ends of the expanding elements.

Also, cleaning of the equipment is greatly facilitated since no dirt can settle in blind corners, e.g. in the slots provided in known apparatus of this kind, behind rivet-heads and in annular grooves. Adhering dirt inevitably results in slowing down of movement, which would be particularly troublesome in the retraction of the expanding elements. Lubrication is essential because of the sliding movements in the expanding head. The lubricant tends to bind dirt and to cause it to gum up and must therefore be renewed from time to time. Lubricant can be easily removed from the expanding head of the invention because of the smooth and readily accessible surfaces of the expanding elements, and this can be done by washing off the lubricant with a solvent and/or by rubbing it off.

Further advantage accrues if each of the expanding elements has, at the point where it extends through the sleeve flange, a projection extending from its working surface. This reliably prevents the end of the pipe, when pushed on to the expanding elements, from accidentally finding its way into the annular gap within the sleeve flange and from impeding radial movement of the expanding elements.

When the connection between the sleeve and the tool body is a screw-threaded connection, further advantage is achieved by providing in the sleeve and between the screwthread and the flange, an annular projection, the inside diameter of which corresponds to the outside diameter of the flange segments of the expanding elements in the fully expanded position. In this way a radial abutment is provided which exerts an additional centering action on the expanding elements.

This arrangement reliably prevents concentration of the expanding elements on one side of the mandrel that would lead to an out-of-round shape in the expanded pipe.

In a further advantageous form of the expanding head of the invention, the sleeve is provided with an internal screw-thread that is considerably larger than the complementary screw-thread provided on the tool body, and a threaded ring having a wider internal thread, corresponding to the complementary screw-thread on the tool holder, can be screwed into the internal thread in the sleeve.

This step enables a sleeve having a considerably larger diameter to be connected to the tool body, in which sleeve expanding elements having larger diameters of flange segments and working surfaces can of course also be accommodated. In this way the use of the tool body can be extended to cover an additional range of pipe-diameters which is above the range covered by a sleeve having a thread diameter corresponding to that of the tool body. The threaded ring, which naturally can be readily exchanged, performs a further function when it has a lower guide surface and, limited by stops, can be screwed so far into the sleeve that an annular gap, in which the flange segments of the expanding elements are movably mounted in the radial direction with slight play, is formed between the guide surface and the sleeve flange. In this way the flange segments are also reliably guided at their outer periphery and are prevented from tilting. This is of importance since the threaded ring is used only in conjunction with very large expanding elements, the force requirement for which, due not least to the larger wall-thickness of the pipe to be expanded, is particularly great. The threaded ring also retains the set of expanding elements in the sleeve so that they cannot be lost but are nevertheless readily exchangeable.

Finally in yet another advantageous form of the expanding head of the invention, the surfaces of the sleeve and of the expanding elements are provided, at those areas where friction occurs, with a wear-reducing coating of hard chromium for example that promotes sliding. Previously only the sleeve has been provided with a surface coating of chromium for example, this for reasons of appearance and for preventing corrosion. The expanding elements on the other hand were not surface-treated. Compared with the untreated expanding elements, this further feature of the invention provides the advantage of reducing the forces required for actuating the expanding tool by up to 30%, other conditions being the same.

BRIEF DESCRIPTION OF THE DRAWINGS

Two forms of construction of the subject-matter of the invention will now be described in greater detail by reference to the attached drawings, in which:

FIG. 1 is a longitudinal section through a tool body having handles and a driving mechanism as well as an expanding head mounted thereon, this being shown in the expanded position.

FIG. 2 is a longitudinal section through an expanding head similar to that shown in FIG. 1, but with a threaded ring for dealing with larger pipe diameters fitted therein.

FIGS. 3 to 6 constitute an exploded view of the unit shown in FIG. 2.

DETAILED DESCRIPTION OF THE INVENTION

Figures 3, 4, 5, 6:
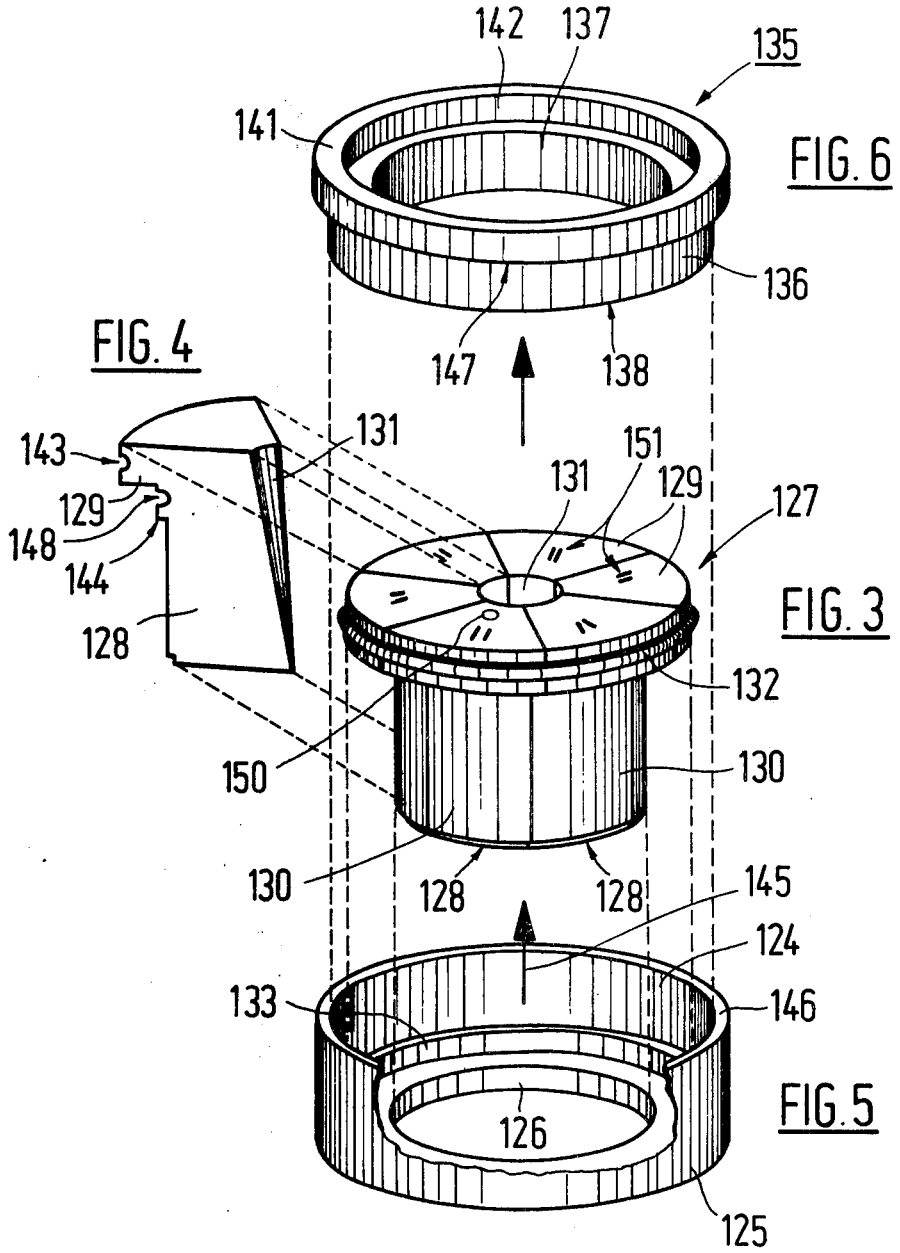
FIG. 3 is a perspective illustration of a self-contained set of expanding elements.
FIG. 4 illustrates a single expanding element after removal from the unit shown in FIG. 3.
FIG. 5 is a perspective illustration of a sleeve for accommodating a set of expanding elements.
FIG. 6 is an illustration, likewise in perspective, of a threaded ring having a double thread for connecting it to the sleeve shown in FIG. 5.

FIG. 1 shows a tool body 10, the outer surface of which is of substantially rotation-symmetrical shape and which contains a longitudinally displaceable mandrel 12 in a coaxial bore 11. A radial lever 13 is secured to the tool body 10. The upper end of the tool body 10 is milled away at 14, where a further lever 16 is mounted by means of a hinge-pin 15, this lever having a cam 17 near its hinge-pin 15. The lever 16 can be swung in the direction of the arrow 18 through the position **16*a* shown in broken lines, wherein the cam 17 occupies the position 17*a***.

At its upper end the mandrel 12 has ahead 19 having an end face 20 on which the cam 17 acts. At its lower end the mandrel 12 comprises a gently tapering portion 21 which projects from the tool body 10. The tool body 10 has an annular lower end 22 around which is formed a screw-thread 23 complementary to a screw-thread 24 formed on the inner face of a sleeve 25. The sleeve 25 has an inwardly extending flange 26 and thereby surrounds a self-contained set 27 of expanding elements 28, details of which will be described by reference to FIGS. 3 and 4. The expanding elements 28 have flange segments 29 which together form an annular flange, and working surfaces 30 which together form a cylindrical surface when the expanded position illustrated in FIG. 1 is reached. The expanding elements 28 have inner surfaces 31, the shape of which complements the geometry of the tapering portion 21 and which form the surfaces over which this tapering portion slides during the expanding movement. A spring element 32 surrounds and biases the flange segments 29 and consists of a solid spring which is bent to circular shape and which presses the expanding elements against each other and against the mandrel 12, in particular against the tapering portion 21 thereof.

Also provided in the sleeve 25 and between the screw-thread 24 and the sleeve flange 26 is an annular projection 33, the inside diameter of which corresponds to the outside diameter of the flange segments in the fully expanded position and thus forms a radial abutment. The parts 24 to 33 together form an expanding head 34. At the place where the expanding elements 28 extend through the sleeve flange 26, they are provided with a machined annular groove 48 in which is fitted a further spring element 49. This spring element may have very soft characteristics and may be formed for example by an O-ring, though it may also consist of a steel wire bent into the form of a ring.

It will be seen from FIG. 1 that the set 27 of expanding elements, held together by the spring elements 32 and 49, can be upwardly removed from the sleeve 25 when the latter is screwed off. It will also be seen that, between the lower end 22 of the tool body 10 and the inner face of the sleeve flange 26, is formed an annular gap in which the flange segments 29 are mounted and are radially movable. By moving the lever 16 in the direction indicated by the arrow 18, the expanding elements 28, six of which are provided in the present case, can move in a radial direction. This enables the end of a pipe, fitted over the working surfaces 30, to be expanded to an extent such that a pipe of the original diameter can be inserted into the expanded portion.

FIG. 2 shows an expanding head 134 of larger dimensions for expanding pipes of greater diameter. In FIG. 2, components having the same construction and function as equivalent components in FIG. 1 are each designated by a reference numeral having a "1" preceding that used in FIG. 1. Furthermore, the internal screw-thread 124 on the sleeve 125 is considerably greater than the complementary screw-thread 23 on the tool body 10. A similar relationship also applies as regards the outside diameter of the flange segments 129 and the working surfaces 130. The radial distance between the screw-thread 124 and the complementary screw-thread 23 (FIG. 1) is filled by a threaded ring 135 having an external screw-thread 136 and an internal screw-thread 137, the external screw-thread 136 being screwed on to the screw-thread 124 on the sleeve 125, whereas the internal screw-thread 137 can be screwed on to the complementary screw-thread 23 on the tool body 10 (FIG. 1).

The threaded ring 135 has a lower guide surface 138, the distance of which from the inner face of the sleeve flange 126 is such that an annular gap 136 is formed between these parts, the flange segments 129 being mounted and radially movable in this gap. In contrast to FIG. 1, FIG. 2 shows the expanding head 134 with the expanding elements 128 in the contracted position, so that the annular gap 139 can be seen just as clearly as an annular gap 140 which is formed between the cylindrical surface of the annular flange 126 and the expanding elements 128. The precise level of the guide surface 138 is established by stops which are formed by the upper limiting face of the sleeve 125 and a flange 141 provided on the threaded ring 135. A machined recess 142 enables the threaded ring 135 to be screwed over the required distance on to the tool body 10 (FIG. 1).

FIGS. 3 to 6 constitute an exploded view of the expanding head 134. FIG. 3 shows the set 127 of expanding elements 128 which, when extracted, are held together by the spring elements 132 and 149 in a safe manner so that they cannot get lost. The expanding elements 28 are segmental parts of a body of rotation which has been divided into six similar parts by axial cuts. The great resistance to bending of the spring elements 132 and 149 (the latter being masked in FIG. 3 because of the perspective illustration) prevents the individual expanding elements 128 from being forced out of the spring elements by moving apart at their separating faces. The expanding elements are united, so that they cannot get lost, by means of annular grooves 143 and 148 of suitable depth, which are formed, on the one hand, in the periphery of the flange segments 129 and, on the other, in the periphery of a projection 144 which is likewise masked in FIG. 3. Details can be seen from FIG. 4. The axial dimension of the projection 144 is slightly greater than the thickness of the sleeve flange 126. It can also be clearly seen that the shape of the internal surface 131 corresponds to the geometry of the tapering portion 21 of the mandrel 12. All of the surfaces of the components illustrated in FIGS. 3 and 4 are hard-chromium plated.

Furthermore, an indexing bore 150 is drilled in one of the expanding elements 128 and this bore is significant in that it is related to a mark 151. This mark indicates to the manufacturer the size of the expanding elements and it must therefore be repeated on each element. To enable the mark to be provided in an economical manner, it must be applied before making the dividing cuts. Also, the dividing cuts should not run through the mark. The indexing bore 150, in conjunction with corresponding indexing pins, enables the mark to be correctly assigned to the individual expanding elements in the stamping apparatus as well as in the machine for making the dividing cuts.

In FIG. 5, the cylindrical wall of the sleeve 125 that is presented to the viewer is shown as partly broken away so as to enable the disposition of the sleeve flange 126 and the projection 133 to be seen more clearly. The sleeve 125 is a rotation-symmetrical part into which the set 127 of expanding elements, shown in FIG. 3, can be inserted from above, i.e. in the direction opposite to that indicated by the arrow 145, the elements 128 being radially displaceable over the required distance for this purpose. If the parts in FIGS. 3 and 5 are of correspondingly smaller dimensions, i.e. if the internal screw-thread 124 on the sleeve 125 can be screwed onto the complementary screw-thread 123 of the tool body 10 of FIG. 1, the basic shape of these parts corresponds to those of the expanding head 34 illustrated in FIG. 1.

However, in the case of the dimensions detailed above, it is necessary to use the threaded ring 135 shown in FIG. 6 in order to enable the sleeve 125 of FIG. 5 to be used in conjunction with the tool body 10 of FIG. 1. As soon as the set 127 of expanding elements, as shown in FIG. 3, is inserted in the sleeve 125 shown in FIG. 5, it can be secured therein, as illustrated in FIG. 2, by means of the threaded ring 135 of FIG. 6, in such manner that its elements cannot get lost, while at the same time it is exchangeable. The entire assembly can then be easily connected to the tool body 10 of FIG. 1. The upper end-face of the sleeve 125 forms a stop 146; the lower annular surface of the flange 141 on the threaded ring 135 forms a stop 147, and these two stops determine the axial dimension of the annular gap 139. Similar relationships apply as regards the upper end-face of the sleeve 25 and the annular surface at the end of the complementary screw-thread 23 on the tool body 10 in the unit shown in FIG. 1.

What is claimed is:

1. An expanding head for pipe end enlarging tools having a tool body including a cylindrical end portion and a removable mandrel having a tapered end extending through the cylindrical end portion of the body and axially movable therein, the expanding head comprising: a plurality of exchangeable segmental expanding elements each having a flange segment, which together form a radially outwardly extending annular flange, and a body segment, which together form a cylindrical working surface; means connecting the segments to unite them as a self-contained set and for radial movement in response to axial movement of the mandrel when in use, the connecting means comprising a first spring element which surrounds the elements at the annular flange in a first annular groove and a second spring element which surrounds the elements at the cylindrical portion in a second annular groove, the two spring elements clamping the expanding elements against each other and against the mandrel; and means for removably connecting the expanding elements as a unit to the cylindrical portion of the tool body without detachment of the spring elements to maintain the expanding elements in the self-contained set both connected and unconnected to the tool body, comprising a sleeve slidingly receptive of the cylindrical portion of the expanding element set as a unit and connectable to the cylindrical portion of the tool body coaxially with the mandrel and having an inwardly extending annular flange positionable behind the annular flange of the expanding elements to coact therewith to mount same in position around the mandrel.

2. An expanding head according to claim 1, wherein at least one of the spring elements comprises a solid spring bent to the shape of a circle.

3. An expanding head according to claim 1, wherein the outside diameters of the expanding elements at the flange segments are greater than those of the working surfaces thereof.

4. An expanding head according to claim 3, wherein each of the expanding elements has a projection extending from its working surface at the portion where it extends through the sleeve flange.

5. An expanding head according to claim 1, wherein the cylindrical portion of the tool body has an external screw thread and the sleeve has an internal screw-thread engageable therewith and an annular inward projection between the screw-thread and the flange, having an inside diameter corresponding to the outside diameter of the flange segments of the expanding elements in the fully expanded position.

6. An expanding head according to claim 1, wherein the tool body has stops thereon and the sleeve, limited by the stops, is screwable onto the tool body to define an annular gap between the sleeve flange and the end of the cylindrical portion of the tool body, in which the flange segments of the expanding elements are receivable and are movable in the radial direction with a slight clearance.

7. An expanding head according to claim 1, wherein the cylindrical portion of the tool body has an external screw thread and the sleeve has an internal screw-thread and a diameter that is larger than the cylindrical portion of the tool body and further comprising a ring having a threaded inner diameter engageable with the tool body and a threaded external diameter engageable with the sleeve.

8. An expanding head according to claim 7, wherein the tool and sleeve body have stops thereon and the threaded ring has a lower guide surface and, delimited by the sleeve stops, is screwable into the sleeve to define an annular gap between the guide surface and the sleeve flange in which the flange segments of the expanding elements are receivable and are movable in the radial direction with a slight clearance.

9. An expanding head according to claim 1, wherein at least one of the spring elements is an O-ring.

10. An expanding head according to claim 1, wherein the surfaces of the sleeve and of the expanding elements are provided with a wear-reducing coating of one of chromium or nickel to facilitate sliding.

11. An expanding head according to claim 1, further comprising an indexing bore drilled in at least one of the expanding elements.

* * * * *

UNITED STATES PATENT AND TRADEMARK OFFICE

CERTIFICATE OF CORRECTION

PATENT NO. : 4,154,083

DATED : May 15, 1979

INVENTOR(S) : Gunter Rothenberger

It is certified that error appears in the above-identified patent and that said Letters Patent are hereby corrected as shown below:

Column 3, line 8, delete "change" and insert --chance--.

Column 7, line 17, after "elements" delete "28" and insert "128".

Signed and Sealed this

*Twenty-fifth* Day of *September 1979*

[SEAL]

*Attest:*

*Attesting Officer*

LUTRELLE F. PARKER

*Acting Commissioner of Patents and Trademarks*